US011721298B2

(12) United States Patent
He

(10) Patent No.: US 11,721,298 B2
(45) Date of Patent: Aug. 8, 2023

(54) DISPLAY PANEL AND DISPLAY DEVICE

(71) Applicant: TCL CHINA STAR OPTOELECTRONICS TECHNOLOGY CO., LTD., Guangdong (CN)

(72) Inventor: Jhenwei He, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/626,549

(22) PCT Filed: Jan. 7, 2022

(86) PCT No.: PCT/CN2022/070765

§ 371 (c)(1),
(2) Date: Jan. 12, 2022

(65) Prior Publication Data

US 2023/0206871 A1 Jun. 29, 2023

(30) Foreign Application Priority Data

Dec. 24, 2021 (CN) ..... 202111596654.1

(51) Int. Cl.
*G09G 3/36* (2006.01)

(52) U.S. Cl.
CPC ..... *G09G 3/3607* (2013.01); *G09G 3/3685* (2013.01); *G09G 2300/0452* (2013.01); *G09G 2320/0209* (2013.01); *G09G 2320/0242* (2013.01); *G09G 2320/0247* (2013.01); *G09G 2320/0626* (2013.01)

(58) Field of Classification Search
CPC ..... G09G 3/3607; G09G 3/3685; G09G 2300/0452; G09G 2320/0209; G09G 2320/0242; G09G 2320/0247; G09G 2320/0626
See application file for complete search history.

(56) References Cited

U.S. PATENT DOCUMENTS

2006/0202927 A1* 9/2006 Lee ..... G02F 1/1368 345/88
2010/0214309 A1* 8/2010 Bae ..... G09G 3/3685 345/55

(Continued)

FOREIGN PATENT DOCUMENTS

CN 104898317 A 9/2015
CN 106023872 A * 10/2016

(Continued)

OTHER PUBLICATIONS

English machine translation of CN 106023872A (Year: 2016).*

*Primary Examiner* — David Tung
(74) *Attorney, Agent, or Firm* — Mark M. Friedman

(57) ABSTRACT

A display panel and a display device are provided. The display panel includes a data driving unit provided a specific sequence of polarities and complementary high/low level for color shift compensation from a 1st terminal to a 16th terminal in each cycle unit to solve an issue of liquid crystal panel flicker, crosstalk, etc.

18 Claims, 4 Drawing Sheets

(56) References Cited

U.S. PATENT DOCUMENTS

| | | | | |
|---|---|---|---|---|
| 2015/0170590 | A1* | 6/2015 | Ahn | G09G 3/3614 345/96 |
| 2020/0320943 | A1* | 10/2020 | Huang | G09G 3/3688 |
| 2021/0166642 | A1 | 6/2021 | He | |

FOREIGN PATENT DOCUMENTS

| | | | |
|---|---|---|---|
| CN | 106023872 | A | 10/2016 |
| CN | 106328039 | A | 1/2017 |
| CN | 107464538 | A | 12/2017 |
| CN | 107886924 | A | 4/2018 |
| CN | 108877730 | A | 11/2018 |
| CN | 208737871 | U | 4/2019 |
| CN | 209343105 | U | 9/2019 |
| CN | 112540486 | A | 3/2021 |
| JP | 2000275611 | A | 10/2000 |

* cited by examiner

DISPLAY PANEL AND DISPLAY DEVICE

FIELD

The present disclosure relates to display panel technologies, and more particularly, to a display panel and a display device.

BACKGROUND

When a liquid crystal display panel is viewed from a viewing angle other than the front view, color deviation and high brightness due to different rotation degrees of the liquid crystal will cause color to be white or blue (color washout). Therefore, prior art proposes a variety of compensation methods, one of which is to split a gray scale value of one sub-pixel into two different gray scale values to display by two sub-pixels. However, in a liquid crystal panel using four-color sub-pixels, this driving method can cause serious problems such as flicker and crosstalk.

Therefore, there is an urgent need to simultaneously solve the above-mentioned issues such as flicker and crosstalk of the liquid crystal panel.

SUMMARY

In view of the above, the present disclosure provides a display panel and a display device to solve the technical issues of flicker and crosstalk of prior art liquid crystal panel.

In order to achieve above-mentioned object of the present disclosure, one embodiment of the disclosure provides a display panel, including:

a substrate including a display region and a non-display region, wherein the display region includes a plurality of scan lines, a plurality of data lines, and a plurality of pixel units disposed in an array, the plurality of pixel units are defined by the plurality of scan lines across the plurality of data lines, each column of the pixel units are connected to a same data line;

the non-display region includes a data driving unit, the data driving unit includes a plurality output terminals, each output terminal is connected to one column of the pixel units by the data line, every 16 consecutive output terminals is defined as a cycle unit including a $1^{st}$ terminal to a $16^{th}$ terminal, the data driving unit is configured to provide data signals to the pixel units respectively through the 1st terminal to the $16^{th}$ terminal, polarities of the data signals provided by a $2^{nd}$ terminal, a $4^{th}$ terminal, a $5^{th}$ terminal, a $7^{th}$ terminal, a $9^{th}$ terminal, a $11^{th}$ terminal, a $14^{th}$ terminal, and the $16^{th}$ terminal are opposite to a polarity of the data signal provided by the 1st terminal, and polarities of the data signals provided by a $3^{rd}$ terminal, a $6^{th}$ terminal, a $8^{th}$ terminal, a $10^{th}$ terminal, a $12^{th}$ terminal, a $13^{th}$ terminal, and a $15^{th}$ terminal are equal to the polarity of the data signal provided by the $1^{st}$ terminal.

In one embodiment of the display panel, electrical levels of the data signals provided by the $2^{nd}$ terminal, the $3^{rd}$ terminal, the $5^{th}$ terminal, the $8^{th}$ terminal, the $10^{th}$ terminal, the $11^{th}$ terminal, the $13^{th}$ terminal, and the $16^{th}$ terminal in the cycle unit are opposite to an electrical level of the data signal provided by the $1^{st}$ terminal in the cycle unit, and electrical levels of the data signal provided by the 4th terminal, the $6^{th}$ terminal, the $7^{th}$ terminal, the $9^{th}$ terminal, the $12^{th}$ terminal, the $14^{th}$ terminal, and the $15^{th}$ terminal are equal to the electrical level of the data signal provided by the 1st terminal in the cycle unit.

In one embodiment of the display panel, the electrical levels of the data signals are complementary levels for color shift compensation.

In one embodiment of the display panel, the complementary levels for color shift compensation of the data signals includes a complementary high level for color shift compensation and a complementary low level for color shift compensation, and each output terminal is configured to provide the complementary high level for color shift compensation and the complementary low level for color shift compensation alternately.

In one embodiment of the display panel, the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

In one embodiment of the display panel, the data driving unit is configured to provide opposite polarities of the data signals to a same output terminal in different image frames.

In one embodiment of the display panel, the data driving unit is configured to provide a same complementary high level or low level for color shift compensation of the data signals to a same pixel unit in different image frames.

In one embodiment of the display panel, the plurality of pixel units include a plurality of first pixel units, a plurality of second pixel units, a plurality of third pixel units, and a plurality of fourth pixel units, the first pixel units are red pixels, the second pixel units are green pixels, the third pixel units are blue pixels, and the fourth pixel units are white pixels.

In one embodiment of the display panel, the $1^{st}$ terminal, the $5^{th}$ terminal, the $9^{th}$ terminal, and the $13^{th}$ terminal are connected to the red pixels respectively, the $2^{nd}$ terminal, the $6^{th}$ terminal, the $10^{th}$ terminal, and the $14^{th}$ terminal are connected to the green pixels respectively, the $3^{rd}$ terminal, the $7^{th}$ terminal, the $11^{th}$ terminal, and the $15^{th}$ terminal are connected to the blue pixels respectively, and the $4^{th}$ terminal, the $8^{th}$ terminal, the $12^{th}$ terminal, and the $16^{th}$ terminal are connected to the white pixels respectively.

Another embodiment of the disclosure further provides a display device, including a display panel and a driving device connected to the display panel through a flexible circuit board, wherein the display panel includes:

a substrate including a display region and a non-display region, wherein the display region includes a plurality of scan lines, a plurality of data lines, and a plurality of pixel units disposed in an array, the plurality of pixel units are defined by the plurality of scan lines across the plurality of data lines, each column of the pixel units are connected to a same data line, the non-display region includes a data driving unit, the data driving unit includes a plurality output terminals, each output terminal is connected to one column of the pixel units by the data line, every 16 output terminals is defined as a cycle unit including a $1^{st}$ terminal to a $16^{th}$ terminal, the data driving unit is configured to provide data signals to the pixel units through the output terminals respectively, polarities of the data signals provided by a $2^{nd}$ terminal, a $4^{th}$ terminal, a $5^{th}$ terminal, a $7^{th}$ terminal, a $9^{th}$ terminal, a $11^{th}$ terminal, a $14^{th}$ terminal, and the $16^{th}$ terminal are opposite to a polarity of the data signal provided by the 1st terminal in each cycle unit, and polarities of the data signals provided by a $3^{rd}$ terminal, a $6^{th}$ terminal, a $8^{th}$ terminal, a $10^{th}$ terminal, a $12^{th}$ terminal, a $13^{th}$ terminal, and a $15^{th}$ terminal are equal to the polarity of the data signal provided by the 1st terminal in each cycle unit.

In one embodiment of the display device, electrical levels of the data signals provided by the $2^{nd}$ terminal, the $3^{rd}$ terminal, the $5^{th}$ terminal, the $8^{th}$ terminal, the $10^{th}$ terminal, the $11^{th}$ terminal, the $13^{th}$ terminal, and the $16^{th}$ terminal in the cycle unit are opposite to an electrical level of the data signal provided by the $1^{st}$ terminal in the cycle unit, and electrical levels of the data signal provided by the $4^{th}$ terminal, the $6^{th}$ terminal, the $7^{th}$ terminal, the $9^{th}$ terminal, the $12^{th}$ terminal, the $14^{th}$ terminal, and the $15^{th}$ terminal are equal to the electrical level of the data signal provided by the 1st terminal in the cycle unit.

In one embodiment of the display device, the electrical levels of the data signals are complementary levels for color shift compensation.

In one embodiment of the display device, the complementary levels for color shift compensation of the data signals includes a complementary high level for color shift compensation and a complementary low level for color shift compensation, and each output terminal is configured to provide the complementary high level for color shift compensation and the complementary low level for color shift compensation alternately.

In one embodiment of the display device, the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

In one embodiment of the display device, the data driving unit is configured to provide opposite polarities of the data signals to a same output terminal in different image frames, and the data driving unit is configured to provide same polarities of the data signals to the same output terminal in a same image frame.

In one embodiment of the display device, the data driving unit is configured to provide a same complementary high level or low level for color shift compensation of the data signals to a same pixel unit in different image frames In one embodiment of the display device, a same column of the plurality of pixel units include pixels with a same color, a first column of pixel units are all red pixels, a second column of pixel units are all green pixels, a third column of pixel units are all blue pixels, and a fourth column of pixel units are all white pixels.

In one embodiment of the display device, the $1^{st}$ terminal, the $5^{th}$ terminal, the $9^{th}$ terminal, and the $13^{th}$ terminal are connected to the red pixels respectively, the $2^{nd}$ terminal, the $6^{th}$ terminal, the $10^{th}$ terminal, and the $14^{th}$ terminal are connected to the green pixels respectively, the $3^{rd}$ terminal, the $7^{th}$ terminal, the $11^{th}$ terminal, and the $15^{th}$ terminal are connected to the blue pixels respectively, and the $4^{th}$ terminal, the $8^{th}$ terminal, the $12^{th}$ terminal, and the $16^{th}$ terminal are connected to the white pixels respectively.

In one embodiment of the display device, the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

In one embodiment of the display device, electrical levels of the complementary level for color shift compensation of the data signals provided by the $2^{nd}$ terminal, the $3^{rd}$ terminal, the $5^{th}$ terminal, the $8^{th}$ terminal, the $10^{th}$ terminal, the $11^{th}$ terminal, the $13^{th}$ terminal, and the $16^{th}$ terminal in the cycle unit are opposite to an electrical level of the complementary level for color shift compensation of the data signal provided by the $1^{st}$ terminal in the cycle unit, and electrical levels of the complementary level for color shift compensation of the data signal provided by the $4^{th}$ terminal, the $6^{th}$ terminal, the $7^{th}$ terminal, the $9^{th}$ terminal, the $12^{th}$ terminal, the $14^{th}$ terminal, and the $15^{th}$ terminal are equal to the electrical level of the complementary level for color shift compensation of the data signal provided by the $1^{st}$ terminal in the cycle unit.

In comparison with prior art, the disclosure provides the display panel and the display device include the data driving unit provided the specific sequence of polarities and complementary high/low level for color shift compensation from the $1^{st}$ terminal to the $16^{th}$ terminal in each cycle unit to solve an issue of liquid crystal panel flicker, crosstalk, etc.

DETAILED DESCRIPTION

Figure 1:
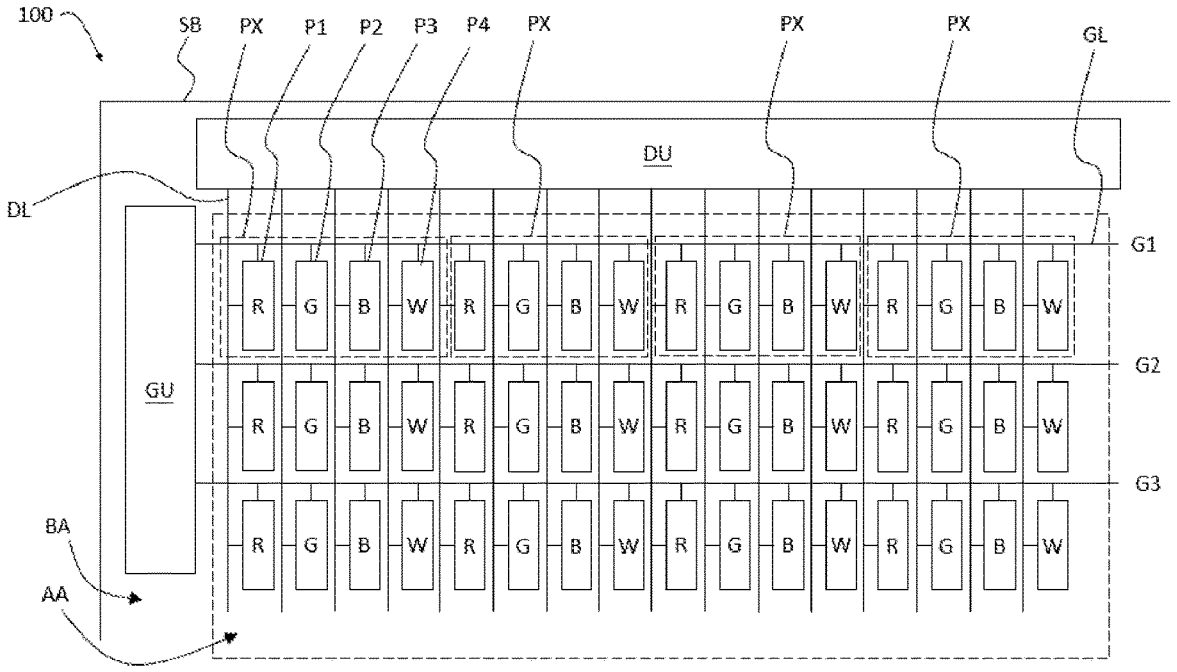
FIG. 1 is a schematic view of a structure of part of a display panel of an embodiment of the present disclosure.

The specific structure and functional details disclosed herein are only representative and are used for the purpose of describing exemplary embodiments of the present application. However, this application can be implemented in many alternative forms, and should not be interpreted as being limited only to the embodiments set forth herein.

In the description of this application, it should be understood that the terms "center", "lateral", "upper", "lower", "left", "right", "vertical", "horizontal", "top", The orientation or positional relationship indicated by "bottom", "inner", "outer", etc. is based on the orientation or positional relationship shown in the drawings, and is only for the convenience of describing the application and simplifying the description, and does not indicate or imply the pointed device Or the element must have a specific orientation, be constructed and operated in a specific orientation, and therefore cannot be understood as a limitation of the present application. In addition, the terms "first" and "second" are only used for descriptive purposes and cannot be understood as indicating or implying relative importance or implicitly indicating the number of indicated technical features. Therefore, the features defined with "first" and "second" may explicitly or implicitly include one or more of these features. In the description of this application, unless otherwise specified, "plurality" means two or more. In addition, the term "including" and any variations thereof is intended to cover non-exclusive inclusion.

In the description of this application, it should be noted that the terms "installation", "connection", and "connection" should be understood in a broad sense unless otherwise clearly specified and limited. For example, it can be a support connection or a detachable connection. Connected or integrally connected; it can be a mechanical connection or an electrical connection; it can be directly connected or indirectly connected through an intermediate medium, and it can be the internal communication between two components. For those of ordinary skill in the art, the specific meanings of the above-mentioned terms in this application can be understood under specific circumstances.

The terminology used here is only for describing specific embodiments and is not intended to limit the exemplary embodiments. Unless the context clearly dictates otherwise, the singular forms "a" and "one" used herein are also intended to include the plural. It should also be understood that the terms "including" and/or "comprising" used herein specify the existence of the stated features, integers, steps, operations, units and/or components, and do not exclude the existence or addition of one or more other features, integers, steps, operations, units, components, and/or combinations thereof.

The application will be further described below in conjunction with the drawings and embodiments.

Figure 2:
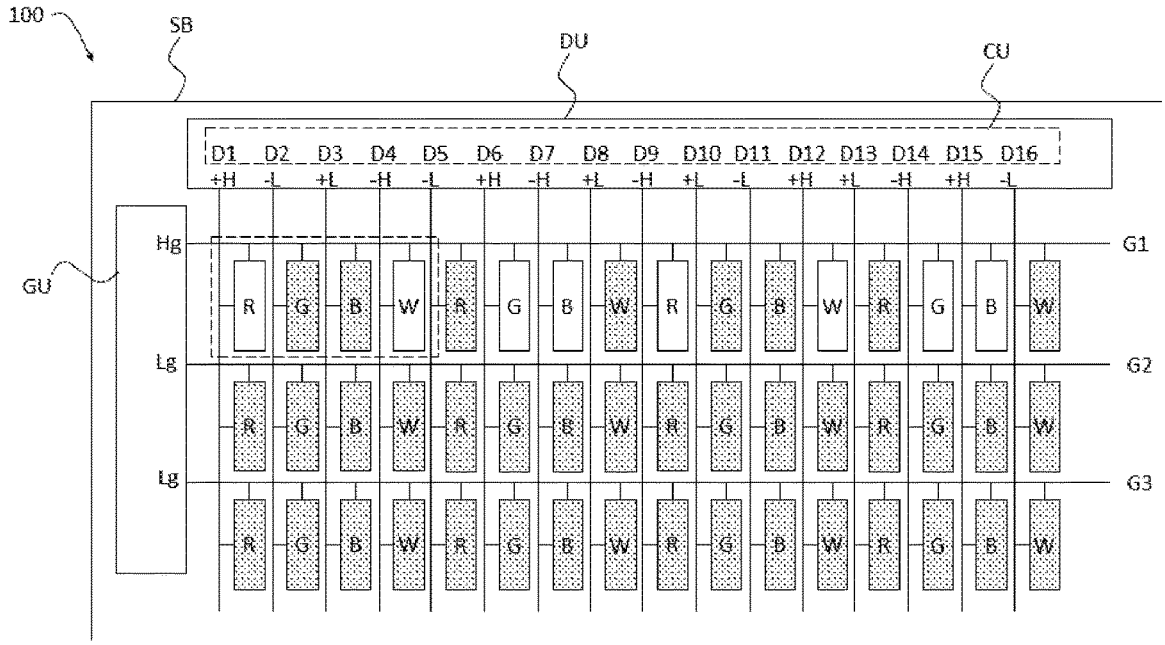
FIG. 2 is a schematic of signals of a data driving unit of an embodiment of the present disclosure.

Referring to FIG. 1 and FIG. 2, FIG. 1 is a schematic view of a structure of part of a display panel of an embodiment of the present disclosure. FIG. 2 is a schematic of signals of a data driving unit of an embodiment of the present disclosure. One embodiment of the disclosure provides a display panel 100.

The display panel 100 includes a substrate SB including a display region AA and a non-display region BA, wherein the display region AA includes a plurality of scan lines SL, a plurality of data lines DL, and a plurality of pixel units P1, P2, P3, and P4 disposed in an array, the plurality of pixel units P1, P2, P3, and P4 are defined by the plurality of scan lines SL across the plurality of data lines DL, each column of the pixel units are connected to a same data line DL.

In detail, every four pixel units form a pixel PX. Each pixel PX includes a first pixel unit P1, a second pixel unit P2, a third pixel unit P3, and a fourth pixel unit P4.

The non-display region BA includes a data driving unit DU, the data driving unit DU includes a plurality output terminals D1, D2, etc., each output terminal is connected to one column of the pixel units by the data line. For example, the $1^{st}$ terminal D1 is connected to a column of red pixels R. Every 16 consecutive output terminals D1 to D16 is defined as a cycle unit CU including a $1^{st}$ terminal D1 to a $16^{th}$ terminal D16. In detail, the non-display region BA includes one or more data driving unit DU. Each data driving unit DU includes one or more cycle units CU. The data driving unit DU is configured to provide data signals to the pixel units respectively through the $1^{st}$ terminal D1 to the $16^{th}$ terminal D16. Polarities (+/−) of the data signals provided by a $2^{nd}$ terminal D2, a $4^{th}$ terminal D4, a $5^{th}$ terminal D5, a $7^{th}$ terminal D7, a $9^{th}$ terminal D9, a $11^{th}$ terminal D11, a $14^{th}$ terminal D14, and the $16^{th}$ terminal D16 are opposite to a polarity (+/−) of the data signal provided by the $1^{st}$ terminal D1, and polarities (+/−) of the data signals provided by a $3^{rd}$ terminal D3, a $6^{th}$ terminal D6, a $8^{th}$ terminal D8, a $10^{th}$ terminal D10, a $12^{th}$ terminal D12, a $13^{th}$ terminal D13, and a $15^{th}$ terminal D15 are equal to the polarity (+/−) of the data signal provided by the $1^{st}$ terminal D1.

In detail, referring to FIG. 2. When the data driving unit DU provides data signals to the first row of pixel units, a first gate line of a gate driving unit provides a high level Hg, and a second gate line and a third gate line provide a low level Lg. Data signals on the output terminals are: high level signal +H of the $1^{st}$ terminal D1, and positive + signals of the $3^{rd}$ terminal D3, the $6^{th}$ terminal D6, the $8^{th}$ terminal D8, the $10^{th}$ terminal D10, the $12^{th}$ terminal D12, the $13^{th}$ terminal D13, and the $15^{th}$ terminal D15 as the same positive polarity + as the data signal of $1^{st}$ terminal D1. Polarity of data signals of the $2^{nd}$ terminal D2, the $4^{th}$ terminal D4, the $5^{th}$ terminal D5, the $7^{th}$ terminal D7, the $9^{th}$ terminal D9, the $11^{th}$ terminal D11, the $14^{th}$ terminal D14, and the $16^{th}$ terminal D16 are all negative − opposite to the positive polarity + of the signal of the $1^{st}$ terminal D1.

In detail, please refer to FIG. 2. When a white image is displayed, take the first pixel unit in the upper left corner of FIG. 2 as an example. The polarity of the four pixel units are +−+− in order. Take the first row of pixel units as an example. There are two brighter red pixels R (white without dots in the figure), and the polarities are respectively +−. There are also two brighter green pixels G, and the polarities are respectively +−. There are two brighter blue pixels B with polarities of −+, and two brighter white pixels W with polarities of −+ respectively. Therefore, horizontal crosstalk will not occur when a pure white color is displayed. Taking the red pixels R in the first row as an example, the signal polarities of the four red pixels R are in order of +−−+, so that horizontal crosstalk will not occur when a pure red color is displayed.

Please refer to FIG. 1 and FIG. 2. In some embodiment of the display panel 100, electrical levels (H/L) of a complementary level for color shift compensation (namely, a color shift compensation complementary level) of the data signals provided by the $2^{nd}$ terminal D2, the $3^{rd}$ terminal D3, the $5^{th}$ terminal D5, the $8^{th}$ terminal D8, the $10^{th}$ terminal D10, the $11^{th}$ terminal D11, the $13^{th}$ terminal D13, and the $16^{th}$ terminal D16 in the cycle unit CU are opposite to an electrical level (H/L) of the complementary level for color shift compensation of the data signal provided by the $1^{st}$ terminal D1 in the cycle unit, and electrical levels (H/L) of the complementary level for color shift compensation of the data signal provided by the $4^{th}$ terminal D4, the $6^{th}$ terminal D6, the $7^{th}$ terminal D7, the $9^{th}$ terminal D9, the $12^{th}$ terminal D12, the $14^{th}$ terminal D14, and the $15^{th}$ terminal D15 are equal to the electrical level (H/L) of the complementary level for color shift compensation of the data signal provided by the $1^{st}$ terminal D1 in the cycle unit CU.

In detail, referring to FIG. 2. When the data driving unit DU provides data signals to the first row of pixel units, a first gate line of a gate driving unit provides a high level Hg. Data signals provided by the data driving unit DU are: a complementary high level H for color shift compensation of the data signal of the $1^{st}$ terminal D1, and complementary high level H for color shift compensation of data signals provided by the $4^{th}$ terminal D4, the $6^{th}$ terminal D6, the $7^{th}$ terminal D7, the $9^{th}$ terminal D9, the $12^{th}$ terminal D12, the $14^{th}$ terminal D14, and the $15^{th}$ terminal D15 as the same complementary high level H for color shift compensation as the data signal of $1^{st}$ terminal D1. Complementary level for color shift compensation of data signals provided by the $2^{nd}$ terminal D2, the $3^{rd}$ terminal D3, the $5^{th}$ terminal D5, the $8^{th}$ terminal D8, the $10^{th}$ terminal D10, the $11^{th}$ terminal D11, the $13^{th}$ terminal D13, and the $16^{th}$ terminal D16 are all complementary low level L for color shift compensation opposite to the complementary high level H for color shift compensation of the signal of the $1^{st}$ terminal D1. In detail, the complementary high level H or low level L for color shift compensation provided by different output terminals are not refer to an exactly same potential value.

In some embodiment of the display panel 100, the complementary levels for color shift compensation of the data signals includes a complementary high level H for color shift compensation and a complementary low level L for color shift compensation, and each output terminal is configured to provide the complementary high level H for color shift compensation and the complementary low level L for color shift compensation alternately.

Figure 3:
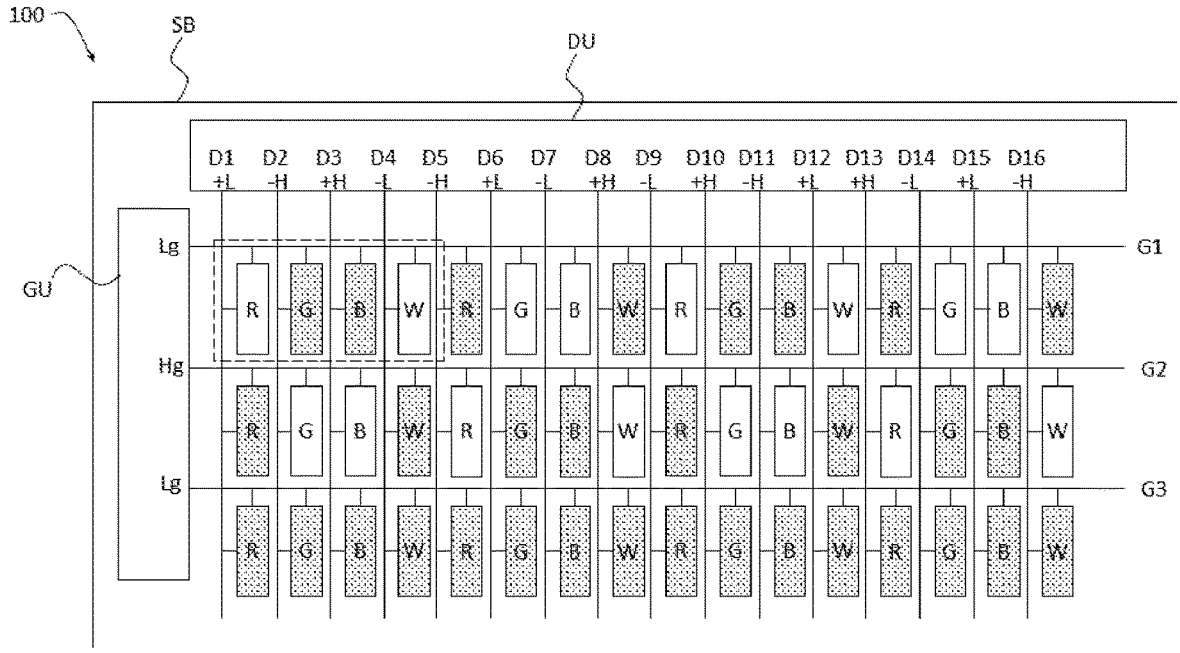
FIG. 3 is another schematic of signals of a data driving unit of an embodiment of the present disclosure.
Figure 4:
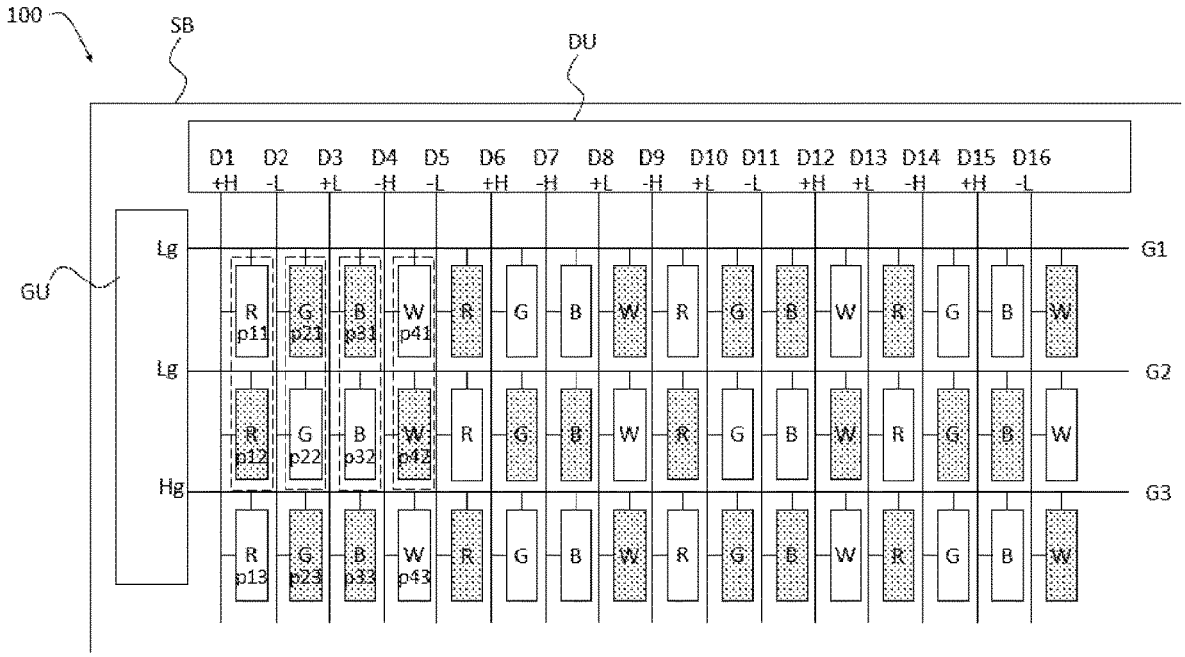
FIG. 4 is still another schematic of signals of a data driving unit of an embodiment of the present disclosure.

In detail, please refer to FIG. 2, FIG. 3, and FIG. 4. FIG. 2, FIG. 3, and FIG. 4 show that the gate driving unit GU sequentially supplies the first gate line G1, the second data line G2, and the third data line G3 high level Hg in one frame of image data to turn on the pixel units in the corresponding row of pixel units to read the potential provided by the output terminals through the data lines. Taking the first terminal D1 as an example, in FIG. 2, the data driving unit DU provides the first terminal D1 with a complementary high level H for color shift compensation. In FIG. 3, the data driving unit DU provides the first terminal D1 with a complementary low level L for color shift compensation. In FIG. 4, the data driving unit DU provides the first terminal D1 with a complementary high level H for color shift compensation. The complementary low level L for color shift compensation and the complementary high level H for color shift compensation of the first terminal D1 appear alternately.

In some embodiment of the display panel 100, the data driving unit DU is configured to provide the complementary low level L for color shift compensation and the complementary high level H for color shift compensation to two pixel units disposed at adjacent rows respectively in a same image frame, an image signals provides an original gray scale value to one of the two pixel units disposed at adjacent rows, a gray scale value of the complementary low level L for color shift compensation is less than the original gray scale value, a gray scale value of the complementary high level H for color shift compensation is greater than the original gray scale value, a whole brightness provided by the gray scale values of the complementary low level L and the complementary high level H for color shift compensation is equal to a brightness provided by the original gray scale value.

Figure 6:
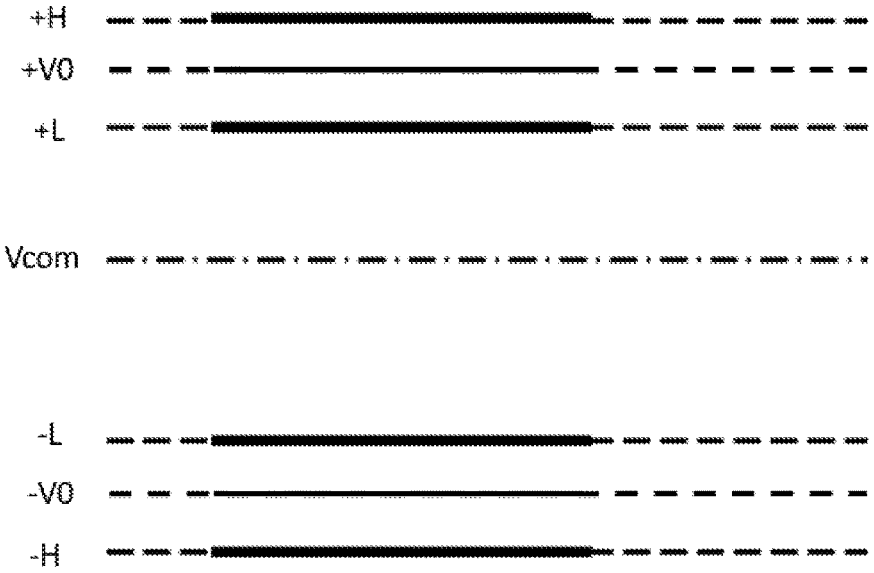
FIG. 6 is a still further schematic of signals of a data driving unit of an embodiment of the present disclosure.

In detail, please refer to FIG. 6, FIG. 6 is a schematic view of a complementary level for color shift compensation provided by an embodiment of the present application. Among them, Vcom is a common potential or ground potential. The embodiment of the present application performs color shift compensation processing in order to reduce the color washout. In detail, the gray scale of one pixel unit is divided into two pixel units to display in different gray scale combinations. As shown in FIG. 6, the potential of the image signal corresponding to the original data signal of the grayscale value of either of the two pixel units is V0. If the liquid crystal molecules are driven directly at this potential V0, an excessive brightness when viewing the LCD panel at a large viewing angle causes the color to be white or blue. Therefore, the original driving gray scale is divided into a higher gray scale and a lower gray scale, corresponding to the color shift compensation complementary high level H and the color shift compensation complementary low level L. The complementary high level H for color shift compensation and the complementary low level L for color shift compensation are provided to two pixel units located in adjacent rows for display. The selection principle of the complementary high level H for color shift compensation and the complementary low level L for color shift compensation is that an average brightness displayed by two pixel units in adjacent rows is equal to an brightness displayed by one pixel unit at the potential V0 of the original data signal.

In detail, providing a negative potential can also deflect the liquid crystal. In order to avoid from long-term driving of the liquid crystal by the direct current causing the liquid crystal deformed inertia and the display quality deteriorated. Therefore, an AC voltage is applied to drive the liquid crystal in a polarity inversion manner. In detail, the color shift compensation process converts the positive polarity original data signal potential +V0 into a positive color shift compensation complementary high level +H and a positive color shift compensation complementary low level +L. The level −V0 of the negative original data signal is converted into a negative color shift compensation complementary high level −H and a negative color shift compensation complementary low level −L.

Figure 8:
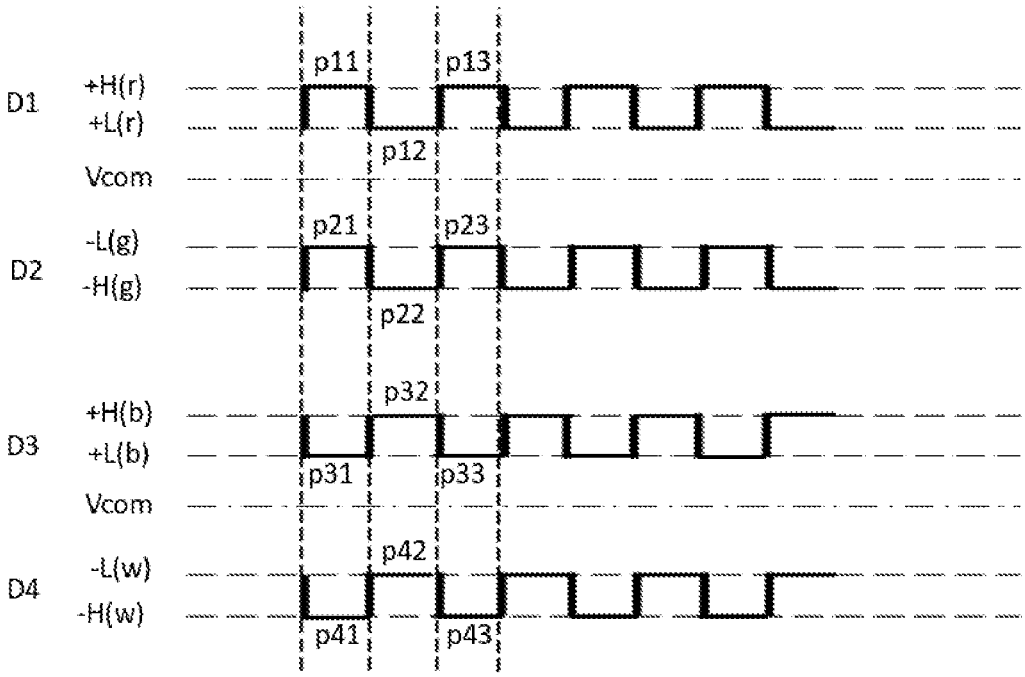
FIG. 8 is a schematic view of data signals of an embodiment of the present disclosure.

In detail, please refer to FIG. 4 and FIG. 8. FIG. 8 is a schematic view of a data signal provided by an embodiment of the present application. Taking a column of pixels PX displaying a monochrome line picture as an example, corresponding to a red pixel, the $1^{st}$ terminal D1 splits the original red grayscale potential into two complementary levels: positive color shift compensation complementary high level +H(r) and positive color shift compensation complementary low level +L(r) alternately appeared and sequentially provided to the pixel units p11, p12, and p13. Corresponding to the green pixel, the second terminal D2 splits the original green gray scale potential into two complementary levels: positive color shift compensation complementary high level +H(g) and positive color shift compensation complementary low level +L(g) appeared alternately and provided to the pixel units p21, p22, and p23 in sequence. Corresponding to the blue pixel, the third terminal D3 splits the original blue grayscale potential into two complementary levels: positive color shift compensation complementary high level +H(b) and positive color shift compensation complementary low level +L (b) alternately appeared and provided to the pixel units p31, p32, and p33 in sequence. Corresponding to the white pixel, the fourth terminal D4 splits the original white grayscale potential into two complementary levels: positive color shift compensation complementary high level +H(w) and positive color shift compensation complementary low level +L(w) appeared alternately and provided to pixel units p41, p42, and p43 in sequence.

In detail, referring to FIG. 4, the pixel units p11 and p12 are a group, and an average brightness provided by them is consistent with a brightness provided by the original red gray scale potential. The pixel units p21 and p22 are a group, and an average brightness provided by them is consistent with a brightness provided by the potential of the original green gray scale. The pixel units p31 and p32 are a group, and an average brightness provided by them is consistent with a brightness provided by the potential of the original blue gray scale. The pixel units p41 and p42 are a group, and an average brightness provided by them is consistent with a brightness provided by the potential of the original white gray scale.

In detail, please refer to FIG. 2, FIG. 3, and FIG. 4. FIG. 3 is another schematic of signals of a data driving unit of an embodiment of the present disclosure, and FIG. 4 is still another schematic of signals of a data driving unit of an embodiment of the present disclosure. FIG. 2 shows that the signal of the first gate line G1 is a high potential Hg, and the data driving unit DU provides the data signal corresponding to the pixel units of the first row. It should be noted here that the high potential Hg of the first gate line G1 and the complementary high potential H for the color shift compensation of the data signal do not refer to a same potential. FIG. 3 shows that the signal of the second gate line G2 is a high potential Hg, and the data driving unit DU provides the data signal corresponding to the pixel units of the second row. FIG. 4 shows that the signal of the third gate line G3 is a high potential Hg, and the data driving unit DU provides the data signal corresponding to the pixel units of the third row. Compared the data signal of FIG. 3 with the data signal of FIG. 2, the data signal of FIG. 3 has inverted the complementary level (H/L) for the color shift compensation. The color shift compensation complementary level (H/L) of the original data signal in FIG. 2 from the $1^{st}$ terminal D1 to the $16^{th}$ terminal D16 in sequence is: HLLHLHHLHLLHLHHL, which is opposite to LHHLHLLHLHHLHLLH in FIG. 3. The polarity of the data signal of each terminal is not inverted. For example, the polarity of the $1^{st}$ terminal D1 is positive + in both FIG. 2 and FIG. 3.

Compared with the data signal of FIG. 3, the data signal of FIG. 4 has inverted the color shift compensation complementary level (H/L) again. The color shift compensation complementary high/low level (H/L) of the original data signal of FIG. 3 from the $1^{st}$ terminal D1 to the $16^{th}$ terminal D16 is LHHLHLLHLHHLHLLH in sequence, and is reversed to HLLHLHHLHLLHLHHL in FIG. 4. The polarity of the data signal of each terminal is not inverted. For example, the signal polarity of the $1^{st}$ terminal D1 is positive + in both FIGS. 4 and 3.

In detail, please refer to FIG. 2. Taking a display of a pure red color as an example, a complementary level for color shift compensation of a signal of the red pixel R in the first row of pixel units are +H, −L, −H, +L in sequence, so the red pixels R in the same row will not be in a high-brightness state at the same time (the white without dots pixel unit in the figure indicates that the pixel unit reads the color shift compensation complementary high level H, and shows a brighter state than the color shift compensation complementary low level L). In addition, the polarities of the red pixels R in the same row are also interleaved with each other, so the issue of crosstalk can be reduced. Please refer to FIG. 3, a complementary level for the color shift compensation of a signal of the red pixels R in the second row of pixel units are +L, −H, −L, +H in sequence. The red pixels R in the same row will not be in high-brightness state at the same time. In addition to the brightness state, the position where the red pixels R of the second row of the pixel units in the high-brightness state is just complementary to the red pixels R of the first row of the pixel units, so it will not cause the issue of flicker.

In some embodiment of the display panel 100, the data driving unit DU is configured to provide opposite polarities (+/−) of the data signals to a same output terminal in different image frames.

Figure 5:
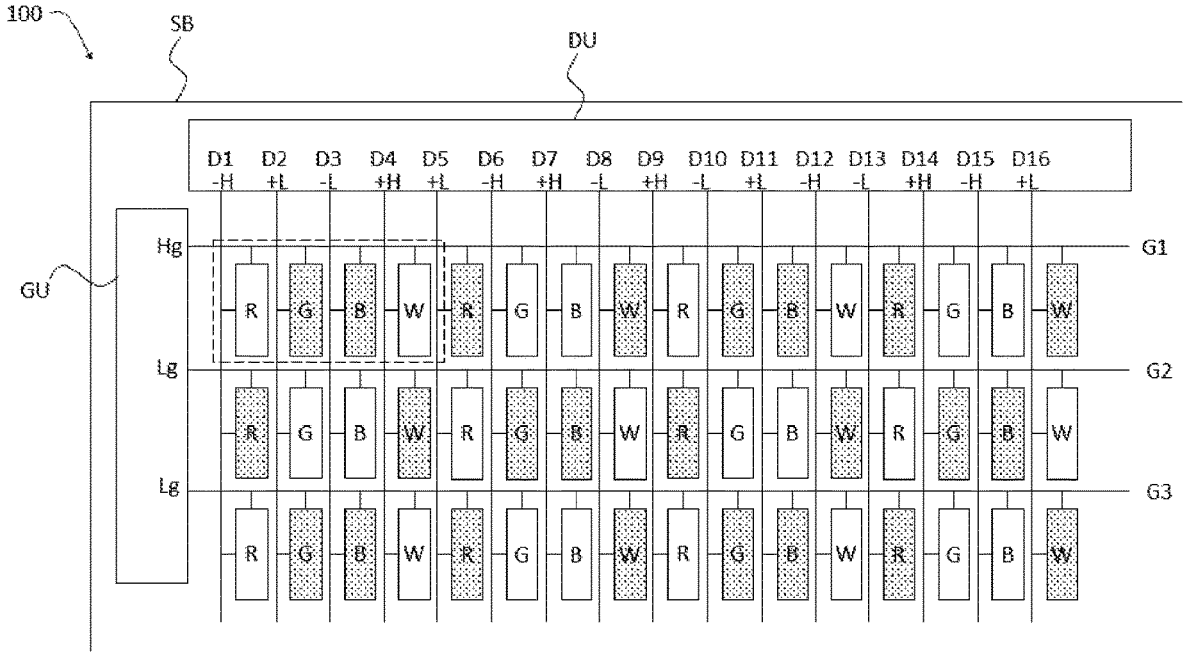
FIG. 5 is a further schematic of signals of a data driving unit of an embodiment of the present disclosure.

In detail, please refer to FIG. 2 and FIG. 5. FIG. 5 is a further schematic of signals of a data driving unit of an embodiment of the present disclosure. FIG. 5 shows that after a signal scanning of a previous frame is done, the signals of another frame starts to scan again. Therefore, the signals supplied to the first gate line G1 by the gate driving unit GU in FIG. 5 returns to the high potential Hg again, and the data driving unit DU provides data signals corresponding to the first row of the pixel units. Compared with the data signals of FIG. 2, the data signal of FIG. 5 has reversed polarity (+/−) of the data signals. The original polarity of the data signals in FIG. 2 from the $1^{st}$ terminal D1 to the $16^{th}$ terminal D16: +−+−−+−+−+−++−+−, is inverted to −+−++−+−+−+−−+−+ in FIG. 5.

In some embodiment of the display panel 100, the data driving unit DU is configured to provide a same complementary high level H or low level L for color shift compensation of the data signals to a same pixel unit in different image frames.

In detail, referring to FIGS. 2 and 5, the signal of the first gate line G1 in FIG. 5 is a high potential Hg, and the data driving unit DU provides the data signals corresponding to the pixel units of the first row. The data signals of FIG. 5 compared with the data signals of FIG. 2 show that the data signals of FIG. 5 are only reversed the polarity (+/−), and not reversed the color shift compensation complementary level (H/L). Originally, the $1^{st}$ terminal D1 of FIG. 2 provides the complementary high level H for color shift compensation, and the $1^{st}$ terminal D1 of FIG. 5 still provides the complementary high level H for color shift compensation. In detail, the color shift compensation complementary levels of the original data signals in FIG. 2 from the $1^{st}$ terminal D1 to the $16^{th}$ terminal D16 are as follows: HLLHLHHLHLLHLHHL, and the data signals in FIG. 5 is still HLLHLHHLHLLHLHHL.

Please refer to FIG. 2, in the display panel 100 of some embodiments of the present application, the data driving unit DU is configured to provide data signals for the $1^{st}$ terminal D1 to the $16^{th}$ provision D16 with polarities of: positive, negative, positive, negative, negative, positive, negative, positive, negative, positive, negative, positive, positive, negative, positive, and negative in the same image frame.

In detail, the data driving unit DU is configured to provide data signals with a fixed polarity (+/−) sequence within the same image frame. In a next image frame, the data driving unit DU provides data signals with reversed polarity for the 1st terminal D1 to the $16^{th}$ terminal D16, namely: negative, positive, negative, positive, positive, negative, positive, negative, positive, negative, positive, negative, negative, positive, negative, and positive.

Referring to FIG. 2, in some embodiment of the display panel 100, the first pixel units P1 are red pixels R, the second pixel units P2 are green pixels G, the third pixel units P3 are blue pixels B, and the fourth pixel units P4 are white pixels W. But the disclosure is not limited to this.

In detail, the white pixels W are pixel units without color resistance in the color resistance layer and showing an original color of a backlight, such as white or white light.

Referring to FIG. 2, in some embodiment of the display panel 100, the 1st terminal D1, the $5^{th}$ terminal D5, the $9^{th}$ terminal D9, and the $13^{th}$ terminal D13 are connected to the red pixels R respectively, the $2^{nd}$ terminal D2, the $6^{th}$ terminal D6, the $10^{th}$ terminal D10, and the $14^{th}$ terminal D14 are connected to the green pixels G respectively, the $3^{rd}$ terminal D3, the $7^{th}$ terminal D7, the $11^{th}$ terminal D11, and the $15^{th}$ terminal D15 are connected to the blue pixels B respectively, and the $4^{th}$ terminal D4, the $8^{th}$ terminal D8, the $12^{th}$ terminal D12, and the $16^{th}$ terminal D16 are connected to the white pixels W respectively.

In detail, referring to FIG. 2, the $1^{st}$ terminal D1 is connected to the pixel units in the first column, all of which are red pixels R. The $5^{th}$ terminal D5 is connected to the pixel units in the fifth column, all of which are red pixels R. The 9th terminal D9 is connected to the pixel units in the ninth column, all of which are red pixels R. The $13^{th}$ terminal D13 is connected to the pixel units in the thirteenth column, all of which are red pixels R.

Figure 7:
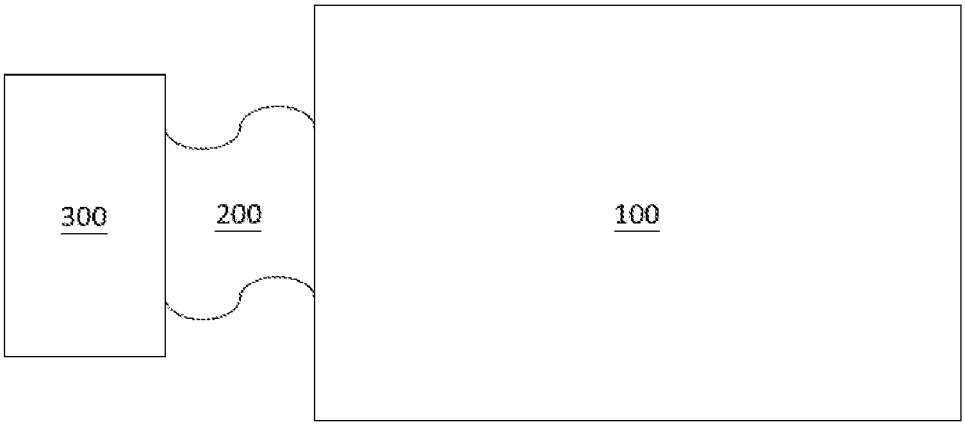
FIG. 7 is a schematic view of a structure of a display device of an embodiment of the present disclosure.

Please refer to FIG. 7, FIG. 7 is a schematic view of a structure of a display device of an embodiment of the present disclosure. Another embodiment of the disclosure further provides a display device DD, including the aforementioned display panel 100 and a driving device 300 connected to the display panel 100 through a flexible circuit board 200

In comparison with prior art, the disclosure provides the display panel and the display device include the data driving unit provided the specific sequence of polarities and complementary high/low level for color shift compensation from the $1^{st}$ terminal to the $16^{th}$ terminal in each cycle unit to solve an issue of liquid crystal panel flicker, crosstalk, etc.

The display panel and the display device provided by the embodiments of the present application are described in detail above.

For the specific implementation of the above operations, please refer to the previous embodiments, which will not be repeated here.

In summary, although the application has been disclosed as above in preferred embodiments, the above-mentioned preferred embodiments are not intended to limit the application. Those of ordinary skill in the art can make various decisions without departing from the spirit and scope of the application. Such changes and modifications, so the protection scope of this application is subject to the scope defined by the claims.

What is claimed is:

1. A display panel, comprising:

a substrate comprising a display region and a non-display region, wherein the display region comprises a plurality of scan lines, a plurality of data lines, and a plurality of pixel units disposed in an array, the plurality of pixel units are defined by the plurality of scan lines across the plurality of data lines, each column of the pixel units are connected to a same data line, the non-display region comprises a data driving unit, the data driving unit comprises a plurality output terminals, each output terminal is connected to one column of the pixel units by the data line, every 16 consecutive output terminals is defined as a cycle unit comprising a 1st terminal to a 16th terminal, the data driving unit is configured to provide data signals to the pixel units respectively through the 1st terminal to the 16th terminal, polarities of the data signals provided by a 2nd terminal, a 4th terminal, a 5th terminal, a 7th terminal, a 9th terminal, a 11th terminal, a 14th terminal, and the 16th terminal are opposite to a polarity of the data signal provided by the 1st terminal, and polarities of the data signals provided by a 3rd terminal, a 6th terminal, a 8th terminal, a 10th terminal, a 12th terminal, a 13th terminal, and a 15th terminal are equal to the polarity of the data signal provided by the 1st terminal;

wherein electrical levels of the data signals provided by the 2nd terminal, the 3rd terminal, the 5th terminal, the 8th terminal, the 10th terminal, the 11th terminal, the 13th terminal, and the 16th terminal in the cycle unit are opposite to an electrical level of the data signal provided by the 1st terminal in the cycle unit, and electrical levels of the data signal provided by the 4th terminal, the 6th terminal, the 7th terminal, the 9th terminal, the 12th terminal, the 14th terminal, and the 15th terminal are equal to the electrical level of the data signal provided by the 1st terminal in the cycle unit.

2. The display panel according to claim 1, wherein the electrical levels of the data signals are complementary levels for color shift compensation.

3. The display panel according to claim 2, wherein the complementary levels for color shift compensation of the data signals comprises a complementary high level for color shift compensation and a complementary low level for color shift compensation, and each output terminal is configured to provide the complementary high level for color shift compensation and the complementary low level for color shift compensation alternately.

4. The display panel according to claim 3, wherein the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

5. The display panel according to claim 3, wherein the data driving unit is configured to provide opposite polarities of the data signals to a same output terminal in different image frames.

6. The display panel according to claim 3, wherein the data driving unit is configured to provide a same complementary high level or low level for color shift compensation of the data signals to a same pixel unit in different image frames.

7. The display panel according to claim 1, wherein the plurality of pixel units comprise a plurality of first pixel units, a plurality of second pixel units, a plurality of third pixel units, and a plurality of fourth pixel units, the first pixel units are red pixels, the second pixel units are green pixels, the third pixel units are blue pixels, and the fourth pixel units are white pixels.

8. The display panel according to claim 7, wherein the 1st terminal, the 5th terminal, the 9th terminal, and the 13th terminal are connected to the red pixels respectively, the 2nd terminal, the 6th terminal, the 10th terminal, and the 14th terminal are connected to the green pixels respectively, the 3rd terminal, the 7th terminal, the 11th terminal, and the 15th terminal are connected to the blue pixels respectively, and the 4th terminal, the 8th terminal, the 12th terminal, and the 16th terminal are connected to the white pixels respectively.

9. A display device, comprising a display panel and a driving device connected to the display panel through a flexible circuit board, wherein the display panel comprises:

a substrate comprising a display region and a non-display region, wherein the display region comprises a plurality of scan lines, a plurality of data lines, and a plurality of pixel units disposed in an array, the plurality of pixel units are defined by the plurality of scan lines across the plurality of data lines, each column of the pixel units are connected to a same data line, the non-display region comprises a data driving unit, the data driving unit comprises a plurality output terminals, each output terminal is connected to one column of the pixel units by the data line, every 16 output terminals is defined as a cycle unit comprising a 1st terminal to a 16th terminal, the data driving unit is configured to provide data signals to the pixel units through the output terminals respectively, polarities of the data signals provided by a 2nd terminal, a 4th terminal, a 5th terminal, a 7th terminal, a 9th terminal, a 11th terminal, a 14th terminal, and the 16th terminal are opposite to a polarity of the data signal provided by the 1st terminal in each cycle unit, and polarities of the data signals provided by a 3rd terminal, a 6th terminal, a 8th terminal, a 10th terminal, a 12th terminal, a 13th terminal, and a 15th terminal are equal to the polarity of the data signal provided by the 1st terminal in each cycle unit;

wherein electrical levels of the data signals provided by the 2nd terminal, the 3rd terminal, the 5th terminal, the 8th terminal, the 10th terminal, the 11th terminal, the 13th terminal, and the 16th terminal in the cycle unit are opposite to an electrical level of the data signal provided by the 1st terminal in the cycle unit, and electrical levels of the data signal provided by the 4th terminal, the 6th terminal, the 7th terminal, the 9th terminal, the 12th terminal, the 14th terminal, and the 15th terminal are equal to the electrical level of the data signal provided by the 1st terminal in the cycle unit.

10. The display device according to claim 9, wherein the electrical levels of the data signals are complementary levels for color shift compensation.

11. The display device according to claim 10, wherein the complementary levels for color shift compensation of the data signals comprises a complementary high level for color shift compensation and a complementary low level for color shift compensation, and each output terminal is configured to provide the complementary high level for color shift compensation and the complementary low level for color shift compensation alternately.

12. The display device according to claim 11, wherein the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

13. The display device according to claim 11, wherein the data driving unit is configured to provide opposite polarities of the data signals to a same output terminal in different image frames, and the data driving unit is configured to provide same polarities of the data signals to the same output terminal in a same image frame.

14. The display device according to claim 11, wherein the data driving unit is configured to provide a same complementary high level or low level for color shift compensation of the data signals to a same pixel unit in different image frames.

15. The display device according to claim 9, wherein a same column of the plurality of pixel units comprise pixels with a same color, a first column of pixel units are all red pixels, a second column of pixel units are all green pixels, a third column of pixel units are all blue pixels, and a fourth column of pixel units are all white pixels.

16. The display device according to claim 15, wherein the 1st terminal, the 5th terminal, the 9th terminal, and the 13th terminal are connected to the red pixels respectively, the 2nd terminal, the 6th terminal, the 10th terminal, and the 14th terminal are connected to the green pixels respectively, the 3rd terminal, the 7th terminal, the 11th terminal, and the 15th terminal are connected to the blue pixels respectively, and the 4th terminal, the 8th terminal, the 12th terminal, and the 16th terminal are connected to the white pixels respectively.

17. The display device according to claim 9, wherein the data driving unit is configured to provide the complementary low level for color shift compensation and the complementary high level for color shift compensation to two pixel units disposed at adjacent rows respectively in a same image frame, an image signals provides an original gray scale value to one of the two pixel units disposed at adjacent rows, a gray scale value of the complementary low level for color shift compensation is less than the original gray scale value, a gray scale value of the complementary high level for color shift compensation is greater than the original gray scale value, a whole brightness provided by the gray scale values of the complementary low level and the complementary high level for color shift compensation is equal to a brightness provided by the original gray scale value.

18. The display device according to claim 17, wherein electrical levels of the complementary level for color shift compensation of the data signals provided by the 2nd terminal, the 3rd terminal, the 5th terminal, the 8th terminal, the 10th terminal, the 11th terminal, the 13th terminal, and the 16th terminal in the cycle unit are opposite to an electrical level of the complementary level for color shift compensation of the data signal provided by the 1st terminal in the cycle unit, and electrical levels of the complementary level for color shift compensation of the data signal provided by the 4th terminal, the 6th terminal, the 7th terminal, the 9th terminal, the 12th terminal, the 14th terminal, and the 15th terminal are equal to the electrical level of the complementary level for color shift compensation of the data signal provided by the 1st terminal in the cycle unit.

* * * * *